United States Patent [19]

White

[11] 4,311,194

[45] Jan. 19, 1982

[54] LINER HANGER AND RUNNING AND SETTING TOOL

[75] Inventor: Pat M. White, Lewisville, Tex.

[73] Assignee: Otis Engineering Corporation, Dallas, Tex.

[21] Appl. No.: 67,779

[22] Filed: Aug. 20, 1979

[51] Int. Cl.[3] ..... E21B 23/04

[52] U.S. Cl. ..... 166/120; 166/208

[58] Field of Search ..... 166/120, 123, 124, 208

[56] References Cited

U.S. PATENT DOCUMENTS

| | | | |
|---|---|---|---|
| 2,270,647 | 1/1942 | Church | 166/120 |
| 2,270,648 | 1/1942 | Church | 166/120 |
| 2,669,305 | 2/1954 | Condra | 166/123 |
| 4,044,826 | 8/1977 | Crowe | 166/120 |

*Primary Examiner*—Ernest R. Purser

*Attorney, Agent, or Firm*—H. Mathews Garland

[57] ABSTRACT

A delayed action hydraulic well liner hanger and running tool for running, setting, and anchoring a string of tubular well bore liner within a well casing as in an oil and gas well including a liner hanger device having expandible slips for anchoring the device in a well casing, slip expanders for expanding the slips, an annular seal element for sealing around the device with the inner wall of the casing, locking slips for holding the casing anchor slips at locked positions and locking slips for holding the annular seal expanded against the casing wall and a running tool for running, setting and anchoring the liner device including a hydraulic piston assembly having a piston operated coupling connectible by shear pin means with an outer sleeve portion of the liner hanger device, a coupling assembly having a threaded nut and a load bearing thrust plate connectible with an inner sleeve portion of the liner hanger device and an expandible dog assembly for engaging the upper end of the outer sleeve portion of the liner hanger device. The liner hanger device is run into a well bore with the running tool connected through the threaded nut with the inner sleeve portion of the hanger device and the hydraulic piston assembly shear pinned with the outer sleeve of the hanger device. Hydraulic fluid pressure communicated to the hydraulic piston assembly first sets the liner slips against the well casing and severs the shear pin connection between the running tool and the liner hanger. The running tool is then lifted and lowered in the liner hanger engaging the running tool dog assembly with the liner hanger expanding and setting the annular seal.

18 Claims, 20 Drawing Figures

LINER HANGER AND RUNNING AND SETTING TOOL

This invention relates to liner hangers for supporting a tubular well bore liner within a well casing and running tools therefor and more specifically relates to a hydraulically operable liner hanger with a delayed action set seal element.

It is well known practice in the oil and gas industry to set and cement in place a tubular liner string within a well casing. Apparatus and procedural steps for setting such a liner in a well are well known. There are commercially available systems for setting the liner either mechanically or hydraulically. Representative of both mechanical and hydraulic set liner hanger devices and techniques for operation therefor are shown in U.S. Pat. No. 4,096,913 issued June 27, 1978 for Hydraulically Set Liner Hanger and Running Tool with Backup Mechanical Setting Means, U.S. Pat. No. 3,195,646 issued July 20, 1965 for Multiple Cone Liner Hanger, U.S. Pat. No. 3,223,170 issued Dec. 14, 1965 for Hydraulic Pressure-Set Liner Hanger, U.S. Pat. No. 3,291,220 issued Dec. 13, 1966 for Hydraulic Set Liner Hanger, and U.S. Pat. No. 3,608,634 issued Sept. 28, 1971 for Hydraulic Set Liner Hanger. Mechanically set liner hangers have disadvantages including difficulty of manipulating the tubing especially where the well is sufficiently crooked to cause the tubing to drag along the wall of the well bore. Hydraulic set liner hangers developed to overcome the problems with the mechanically set hangers have not included a seal element for sealing with the casing wall around the hanger. Such a seal element is desirable to overcome difficulties encountered during the well cementing operations including particularly a U-tube effect which causes the cement to back-flow before setting.

It is, therefore, a principal object of the invention to provide a new and improved well liner hanger and running tool therefor.

It is another object of the invention to provide a hydraulically operable liner hanger and running tool which includes a seal element for sealing with the wall of a well bore around the liner hanger.

It is another object of the invention to provide a hydraulically operable liner hanger and running tool of the delayed action type wherein the slips of the liner hanger are first set and thereafter in a completely separate operation the annular seal is expanded and locked.

It is another object of the invention to provide a liner hanger of the character described which does not require tubing rotation for setting the hanger.

It is another object of the invention to provide a liner hanger of the character described including apparatus which permits manipulation of the slips to set the slips through the seal element.

It is another object of the invention to provide a hydraulically set liner hanger which includes an inner tubular mandrel having slip expanders thereon and an outer tubular mandrel slidably disposed on the inner mandrel having locking slips positioned to coact with the slip expanders and supporting the annular seal element.

It is another object of the invention to provide a running tool for a hydraulically set liner hanger of the character described which includes a hydraulic piston assembly connectible with the outer mandrel of the liner hanger for hydraulically moving the outer mandrel to set the slips, a coupling assembly including a threaded nut and annular thrust plate connectible with the liner hanger inner mandrel for holding the inner mandrel while the outer mandrel is manipulated, and an expandible dog assembly for engagement with the outer mandrel of the liner hanger after setting the slips to expand the liner hanger annular seal.

In accordance with the invention there is provided a combination liner hanger and running tool therefor wherein the liner hanger comprises an inner tubular mandrel having means at the upper end thereof for connection with the running tool, means at the lower end thereof for connection with a string of tubular liner, and external slip expanders along a lower portion thereof, an outer tubular mandrel telescoped in sliding relation over the inner tubular mandrel including along a lower end portion locking slips operable with the slip expanders on the inner mandrel, an external annular seal assembly expandible responsive to a downward force on the upper end of the outer mandrel, locking means for holding the inner and outer mandrels against relative movement after setting of the slips and locking means for holding the annular seal assembly expanded, and a running tool operable with the liner hanger including an inner mandrel assembly having a coupling nut and thrust plate along a lower end portion thereof connectible with the upper end of the inner mandrel of the liner hanger, a hydraulic piston assembly connectible with the upper end of the liner hanger outer mandrel for moving the liner hanger outer mandrel relative to the liner hanger inner mandrel to set the slips, and an expandible dog assembly for engaging the upper end of the liner hanger outer mandrel to expand the annular seal assembly on the liner hanger after setting the slips.

The invention and its objects and advantages will be better understood from the following detailed description of a preferred embodiment of the liner hanger and running tool therefor constructed in accordance with the invention in conjunction with the accompanying drawings wherein.

Figure 4A:
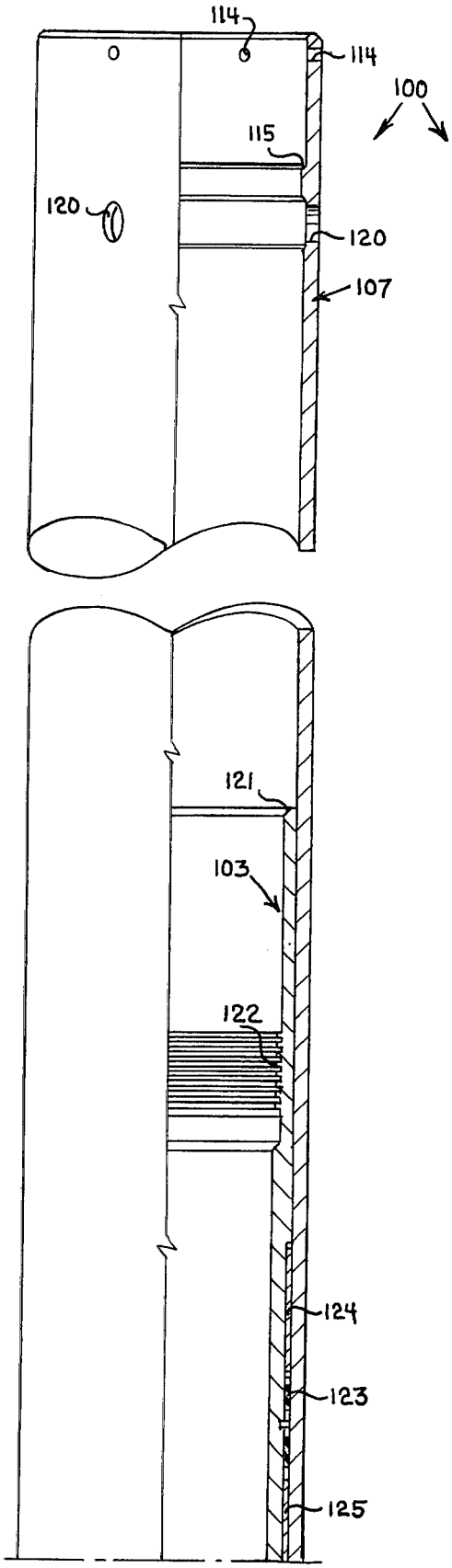
Figure 4B:
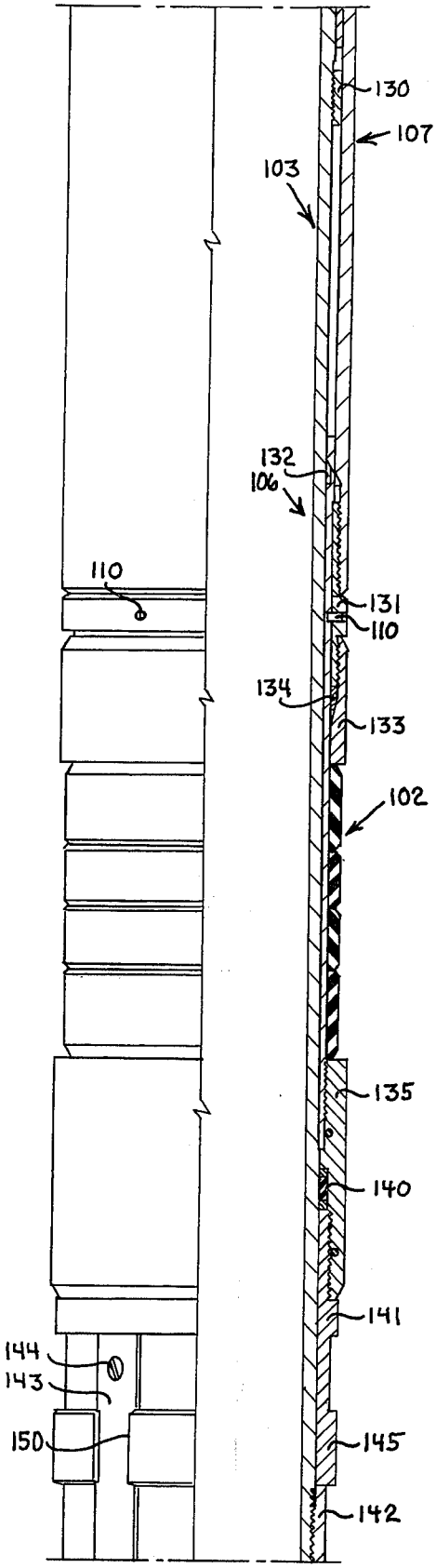
Figure 4C:
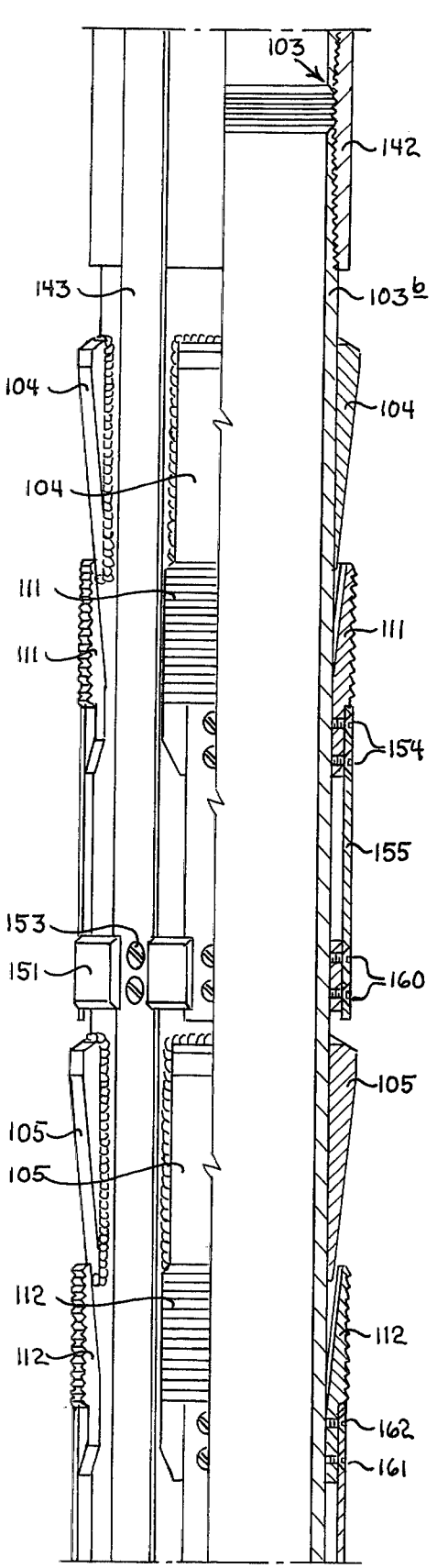
Figure 4D:
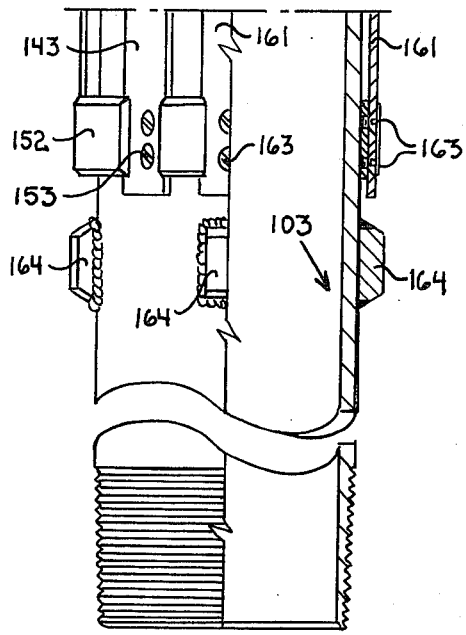
Figure 5A:
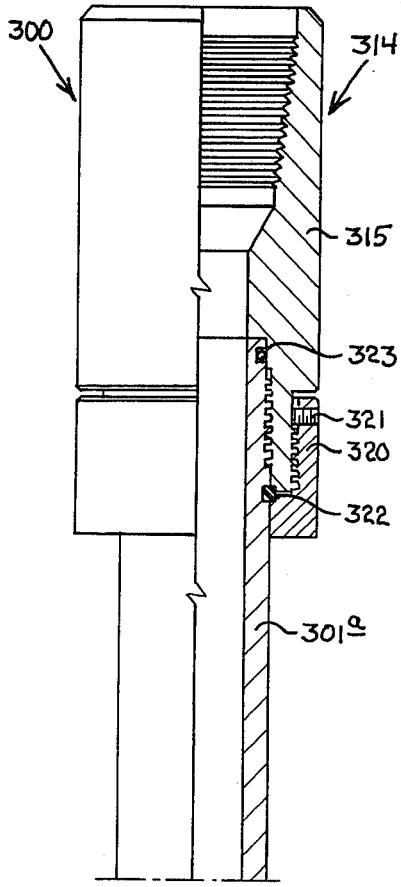
Figure 5B:
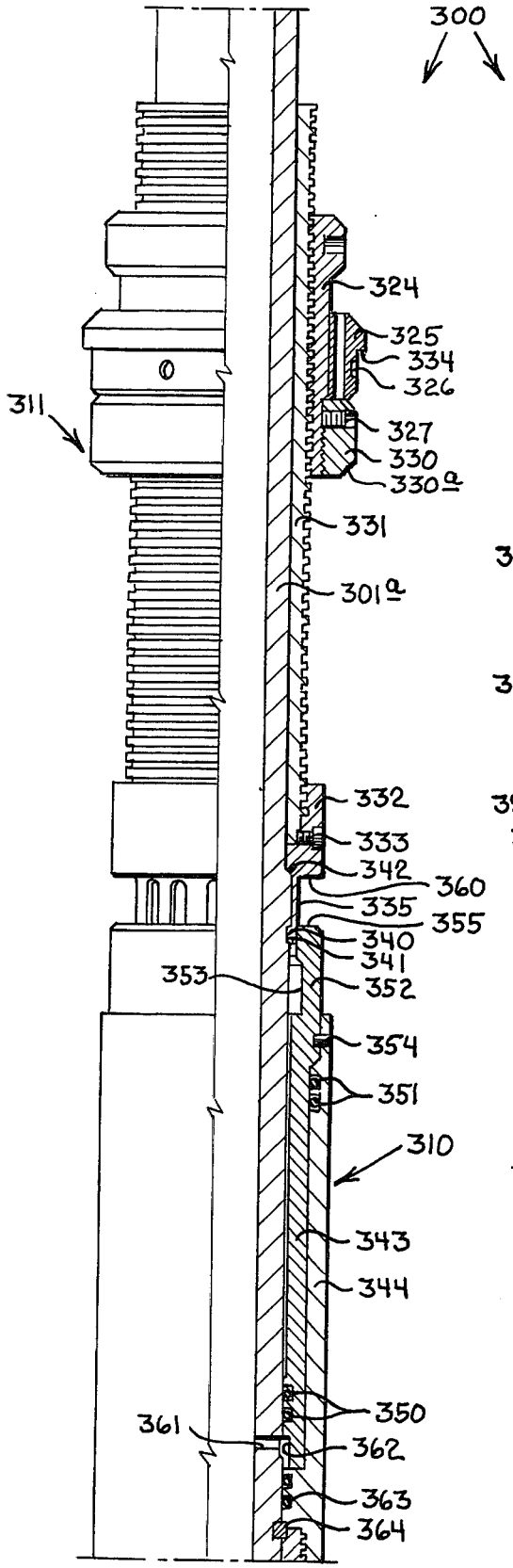
Figure 5C:
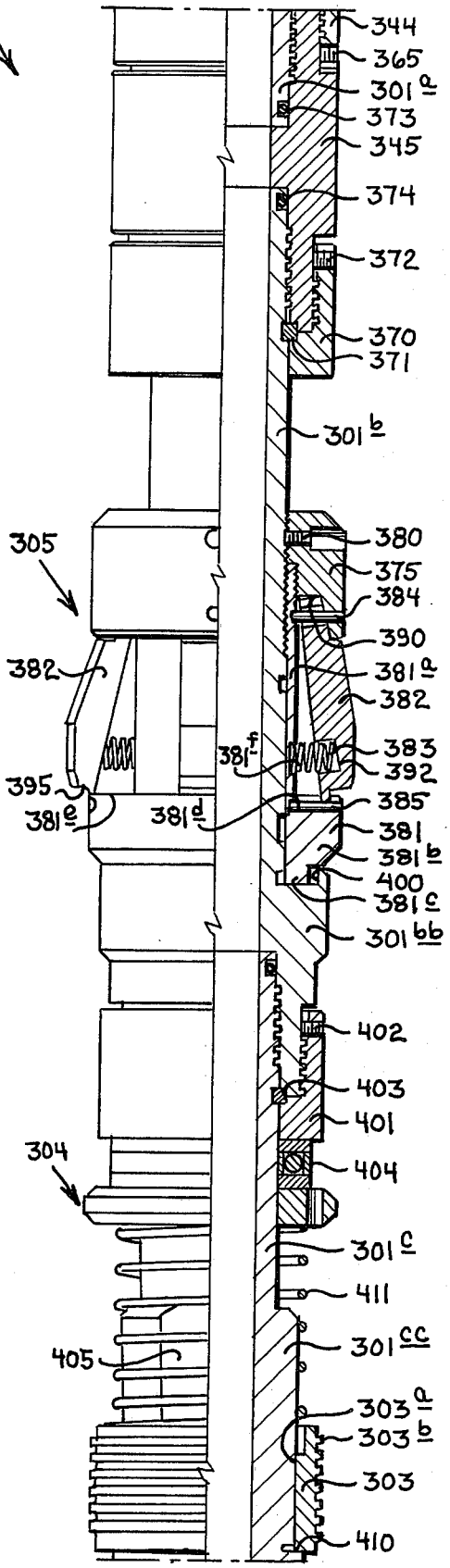
Figure 5D:
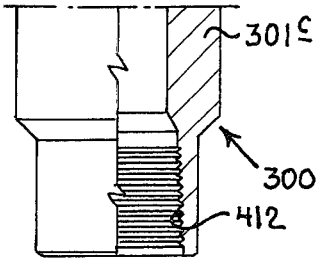

FIGS. 4A–4D inclusive taken together form a longitudinal view in section and elevation of the liner hanger of the invention;

FIG. 4A shows the upper end portion of the liner hanger;

FIG. 4B shows the upper central portion of the liner hanger showing the annular seal assembly;

FIG. 4C shows the lower central portion of the liner hanger showing the slip expander and slip structure of the hanger;

FIG. 4D shows the lower end portion of the liner hanger;

FIGS. 5A–5D inclusive taken together form a longitudinal view in section and elevation of the running tool for the liner hanger;

FIG. 5A shows the upper end portion of the running tool;

FIG. 5B shows the upper central portion of the running tool showing primarily the hydraulic piston assembly of the running tool and the apparatus for connection of the running tool with the liner hanger outer mandrel;

FIG. 5C shows the lower central portion of the running tool showing primarily the coupling nut and thrust plate for connecting the running tool with the inner mandrel of the liner hanger and the expandible locking dog assembly engageable with the upper end of the liner hanger outer mandrel when expanding the annular seal;

FIG. 5D shows the lower end of the running tool mandrel.

Figure 6A:
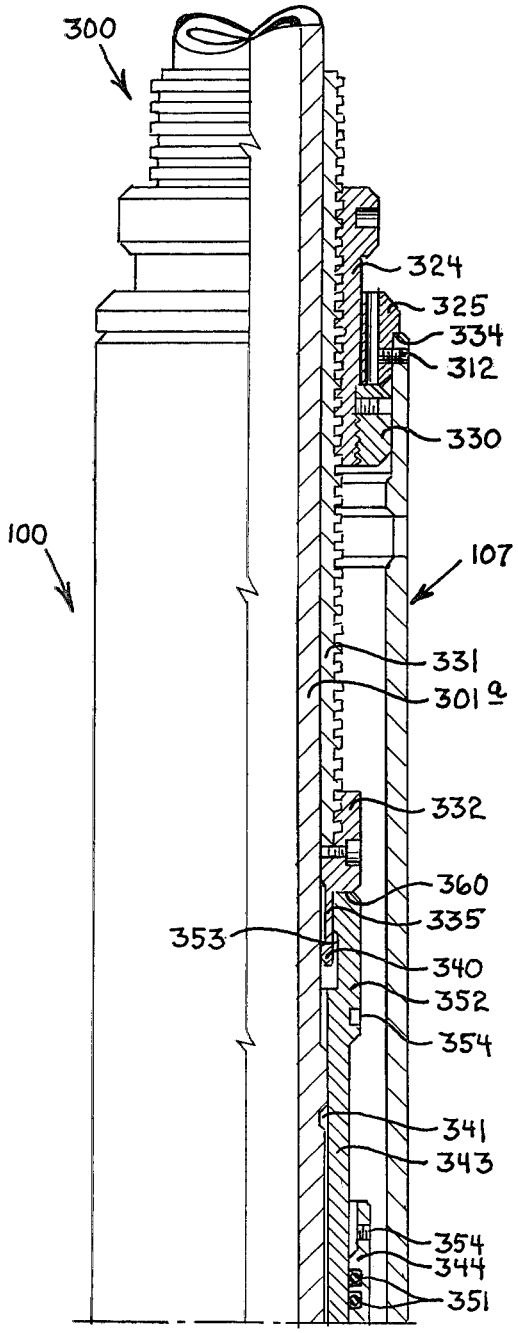
Figure 6B:
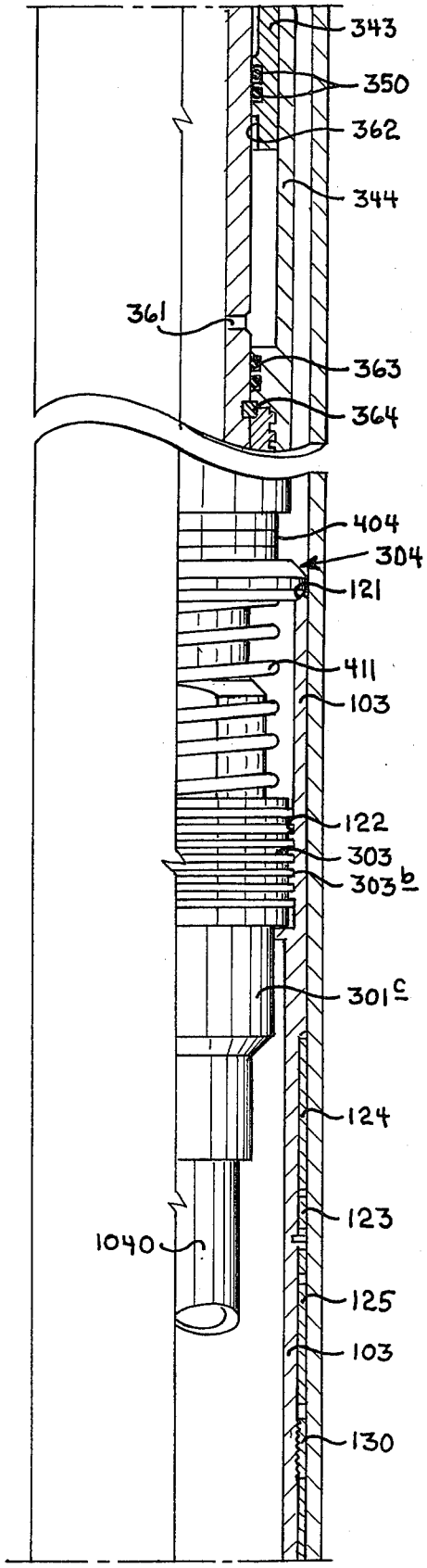
Figure 6C:
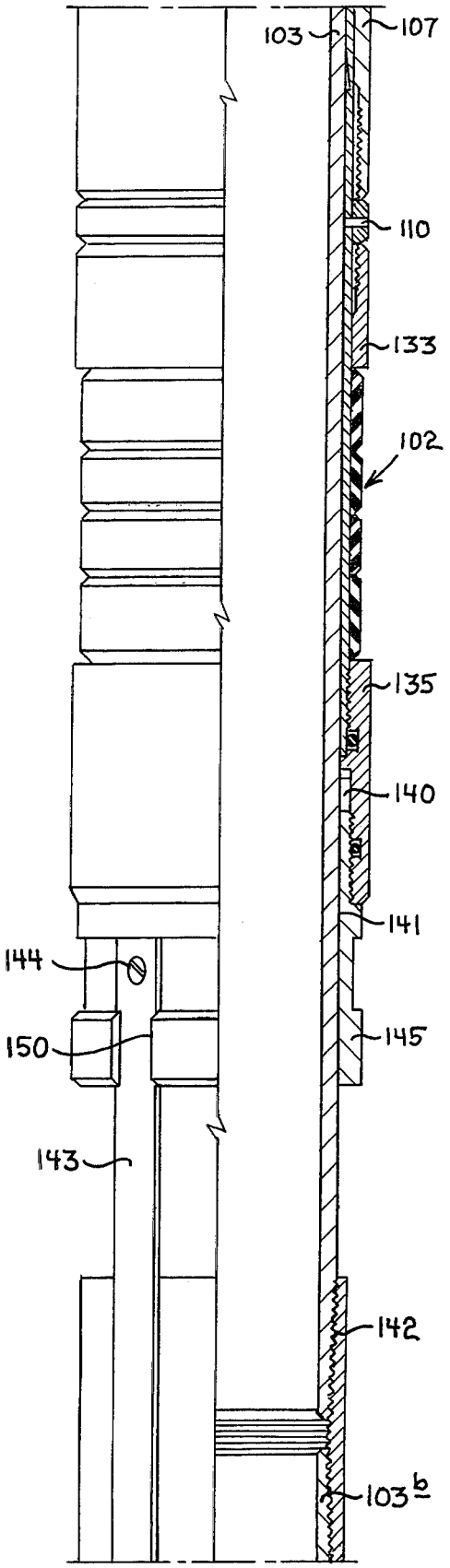
Figure 6D:
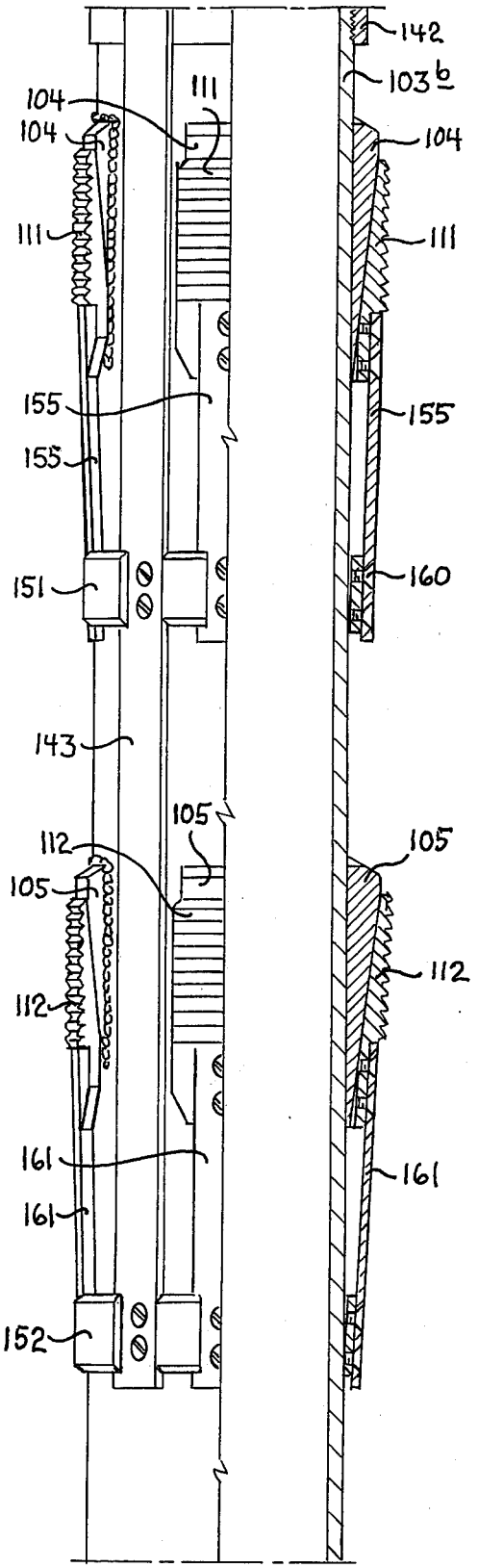
Figure 6E:
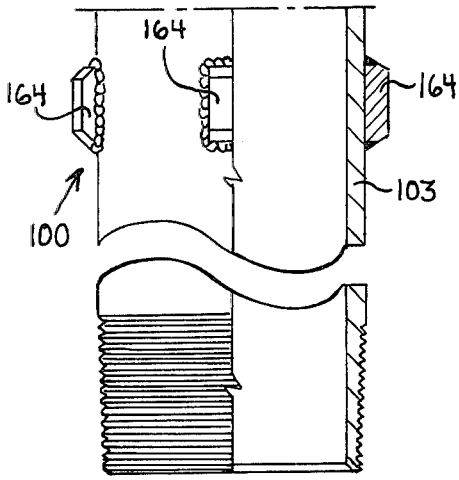
Figure 7A:
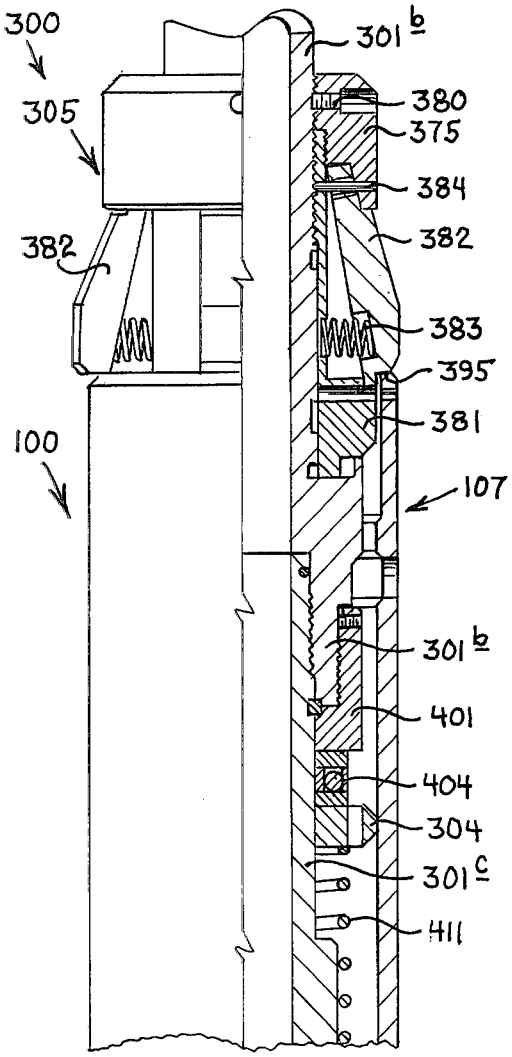
Figure 7B:
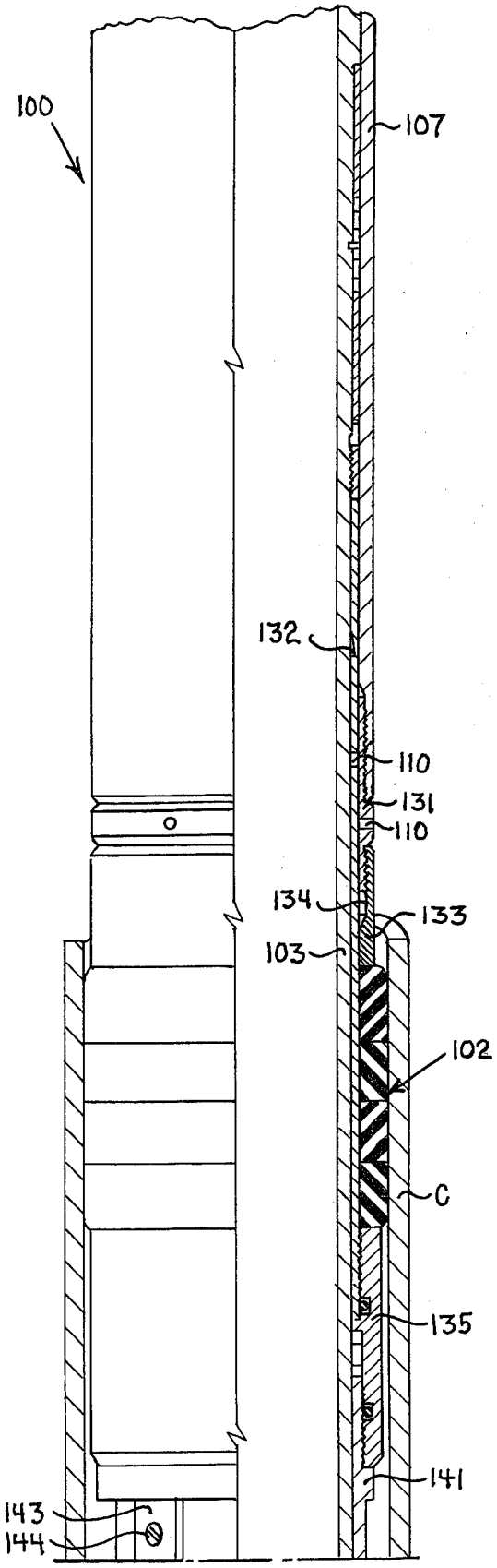
Figure 7C:
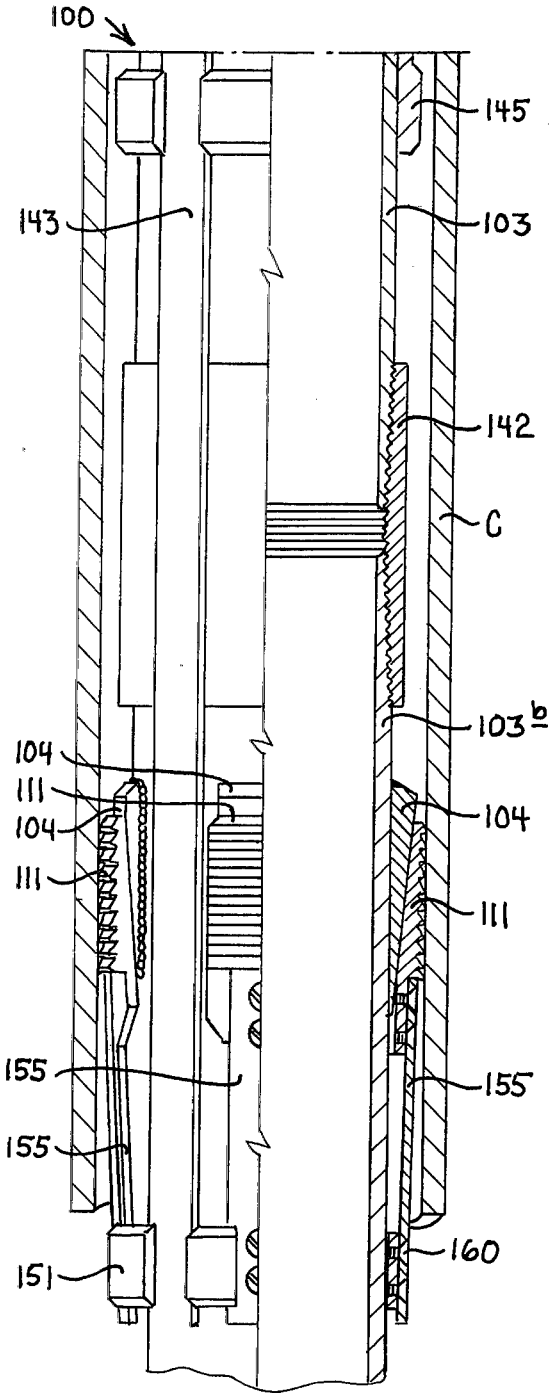
Figure 8:
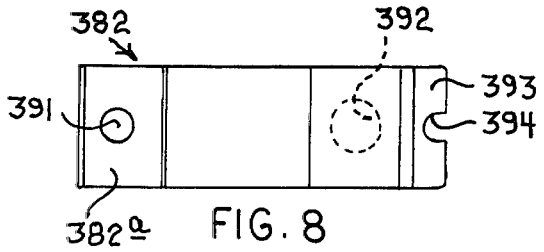

FIGS. 6A–6E taken together form a longitudinal view in section and elevation of the liner hanger and running tool coupled together and operated to expand the slips for setting the slip against a well casing wall;

FIG. 6A shows the major portion of the hydraulic piston assembly of the running tool coupled with the upper end portion of the outer mandrel of the liner hanger;

FIG. 6B shows the lower end portion of the hydraulic piston assembly, the nut and thrust plate coupling the running tool with the liner hanger inner mandrel and a portion of the outer mandrel liner hanger;

FIG. 6C shows the lower end portion of the liner hanger outer mandrel with the seal assembly shifted upwardly to the position at which the slips are set with the casing wall;

FIG. 6D shows the slip assembly portion of the liner hanger showing the slips moved upwardly and outwardly to expanded position on the slip expanders along the inner mandrel of the liner hanger;

FIG. 6E shows the lower end of the liner hanger;

FIGS. 7A–7C taken together form a longitudinal view in section and elevation of the liner hanger and the running tool disconnected from the outer and inner mandrel and telescoped into the outer mandrel against the upper end of the mandrel for expanding the annular seal on the liner hanger;

FIG. 7A shows the upper end portion of the outer mandrel of the liner hanger and the central portion of the running tool showing particularly the expandible dog assembly of the running tool engaged with the upper end of the liner hanger outer mandrel;

FIG. 7B shows the liner hanger showing the annular seal assembly of the hanger expanded against the inner wall of the casing;

FIG. 7C shows the upper slips of the liner hanger engaged with the inner wall of the casing; and FIG. 8 is a longitudinal view in elevation of one of the expandible locking dogs on the running tool.

Figure 1:
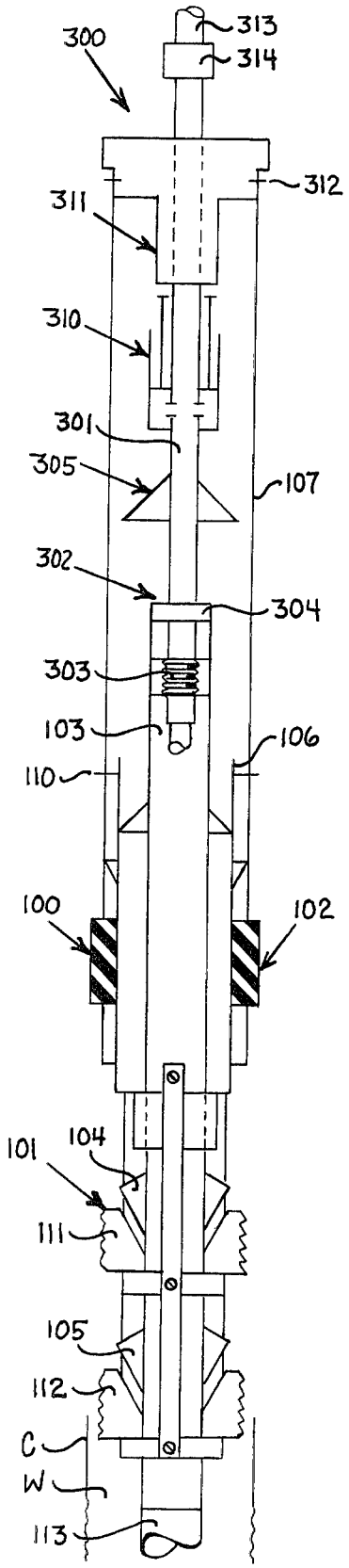
FIG. 1 is a schematic longitudinal view in section and elevation of the liner hanger coupled with the running tool being lowered into a well bore.

In FIG. 1, a hydraulic liner hanger 100 is illustrated coupled with and being run by a running tool 300 into a well bore W having a casing C along a portion of the length of the well bore. The liner hanger includes a slip assembly 101 for locking the liner hanger with the inner wall surface of the casing C and an annular expandible seal assembly 102 for sealing around the liner hanger with the inner wall of the casing. The liner hanger has an inner tubular mandrel 103 which supports a set of upper slip expanders 104 and lower slip expanders 105. The inner mandrel of the liner hanger telescopes into the lower end portion of an outer mandrel comprising a lower tubular mandrel 106 and an upper tubular mandrel 107. The upper outer mandrel 107 is releasably connected by shear pins 110 with the lower outer mandrel 106. The annular seal assembly 102 is carried by the lower outer mandrel 106 by structure described in detail hereinafter which permits the expansion of the seal assembly in response to the downward movement of the mandrel 107 on the mandrel 106 after shearing the pins 110. Sets of upper slips 111 and lower slips 112 depend from the lower end of the lower outer mandrel 106 for coacting with the slip expanders 104 and 105, respectively, to expand the slips for securing the liner hanger with the casing wall. The running tool 300 has an elongated central body mandrel 301 made up of a plurality of tubular sections described in detail hereinafter. A coupling assembly 302 including an external threaded nut 303 and an annular thrust plate 304 are mounted along the lower end portion of the body mandrel 301 for connecting the running tool with the upper end of the inner mandrel 103 of the liner hanger. Above the coupling assembly 302, a seal setting dog assembly 305 is mounted on the running tool mandrel 301 used to engage the upper end of the liner hanger outer mandrel 107 when expanding the seal assembly 102. Above the dog assembly 305 a hydraulic piston assembly 310 is mounted on the running tool body mandrel for coacting with a coupling sleeve assembly 311 which is connectible by shear pins 312 with the upper end of the outer upper mandrel 107 of the liner hanger.

Figure 2:
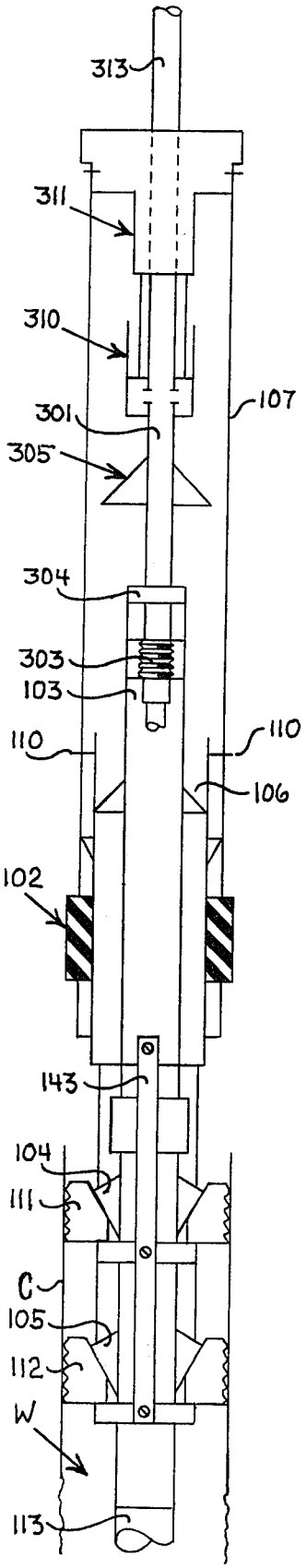
FIG. 2 is a schematic view similar to FIG. 1 showing the slips of the liner hanger expanded into the wall of the well casing by operation of the hydraulic piston assembly of the running tool.
Figure 3:
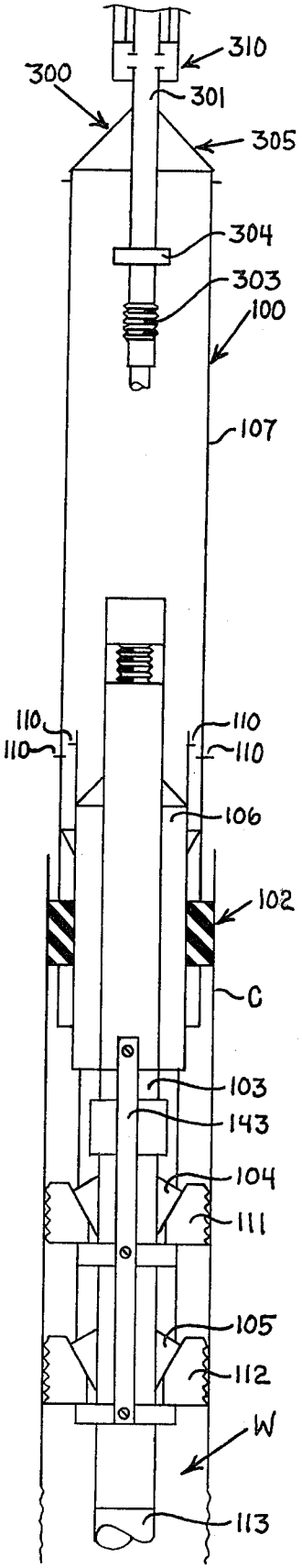
FIG. 3 is a schematic view similar to FIGS. 1 and 2 illustrating the running tool uncoupled from the liner hanger and resting on the upper end of the liner hanger for expanding the annular seal assembly on the liner hanger.

Briefly, the operation of the liner hanger 100 and the running tool 300 is as follows. The running tool is coupled with the liner hanger by connection of the threaded nut 303 into the upper end of the liner hanger inner mandrel 103 with the thrust plate 304 resting on the upper end of the liner hanger mandrel for supporting the weight of the running tool and a handling tubing string 313 extending to the surface end of the well to equipment used for manipulation of the running tool in the well bore. The upper end of the upper outer mandrel 107 of the liner hanger is connected by shear pins 312 with the running tool coupling sleeve assembly 311. In running-in condition the locking slips on the liner hanger are retracted inwardly below the slip expanders and the annular seal assembly 102 is in a relaxed retracted condition. The liner hanger supported on the running tool is lowered into the well bore to the depth at which the liner hanger is to be set within the casing C so that a string of liner 113 supported from the lower end of the liner hanger may be suspended in the well bore by the liner hanger and thereafter cemented in place by forming cement downwardly through the handling string 313 and the running tool and outwardly and upwardly around the liner within the well bore. At the desired depth the hydraulic piston assembly 310 is operated by forming hydraulic fluid downwardly through the handling string 313 into the piston assembly lifting the coupling sleeve 311 raising the outer upper and lower mandrels 106 and 107 of the liner hanger relative to the inner mandrel 103 of the liner hanger lifting the slips 111 and 112 upwardly along the upper and lower expanders 104 and 105 respectively forcing the slips outwardly into contact with the inner wall of the casing C as shown in FIG. 2. The slips 111 and 112 wedge tightly between the slip expanders and the casing inner wall tightly locking the liner hanger with the casing. With the slips 111 and 112 wedged against the casing wall the hydraulic pressure operating the running tool tending to lift the coupling sleeve 311 shears the pins 312 connecting the coupling sleeve with the upper end of the upper outer liner hanger mandrel 107. The weight of the liner 113 is now supported by the liner hanger engaging the casing. The lifting force on the handling string 313 at the surface is relaxed allowing the weight of the handling string and the running tool to rest through the thrust plate 304 on the upper end of the liner hanger inner mandrel 103 so that the slip expanders 104 are urged downwardly wedging the slips 111 and 112 even more tightly against the casing wall. Utilizing routine cementing procedures cement is then forced downwardly through the handling string 313 and the running tool outwardly around the lower end of the liner 113 and upwardly within the well bore around the liner and the liner hanger until the level of the cement is above the seal assembly 102. The running tool is then disengaged from the liner hanger by rotating the handling string and the tool to disengage the threaded nut 303 from the upper end of the inner mandrel 103 of the liner hanger. The handling tool is then lifted until the setting dog assembly 305 is above the upper end of the liner hanger upper outer sleeve 107 and the running tool and handling string are lowered engaging the setting dog assembly 305 with the upper end of the upper outer liner hanger sleeve 107. The weight of the handling tool and handling string are allowed to press downwardly on the liner hanger mandrel shearing the pins 110 which interconnect the upper outer and lower inner mandrels of the liner hanger. When the pins are sheared the upper outer mandrel 107 is forced downwardly relative to the lower inner mandrel expanding the seal assembly 102 against the inner wall of the casing as represented in FIG. 3. The running tool may then be removed for further well procedures as desired. Since the running tool is no longer coupled with but simply rests on the upper end of the liner hanger, the running tool is simply pulled upward by means of the handling string 315.

Specific details of the construction of the liner hanger 100 are illustrated in FIGS. 4A–4D inclusive. Referring to FIG. 4A, the upper end of the upper outer liner hanger mandrel 107 includes shear pin holes 114 for the shear pins 312 to connect the running tool 300 with the liner hanger. The mandrel 107 has an internal annular tapered stop shoulder 115 for engagement of a corresponding tapered shoulder on the running tool coupling sleeve assembly 311. Below the stop shoulder 115 the mandrel 107 is provided with a plurality of circumferentially spaced holes 120 to allow fluid bypass when moving the running tool along a fluid filled well bore. The upper end of the inner mandrel 103 is provided with a tapered stop shoulder 121 for the thrust plate 304 on the running tool. The upper end portion of the mandrel 103 also is provided with internal threads 122 for engagement of the nut 122 on the handling tool. Below the threads 122 the external diameter of the mandrel 103 is reduced and the mandrel is provided with an annular seal 123 disposed between seal spacers 124 and 125 held in position on the mandrel by a threaded retainer ring 130 shown in FIG. 4B. The seal 123 is carried by the mandrel 103 and seals between the outer surface of the mandrel 103 and the inner surface of the upper outer mandrel 107. Referring to FIG. 4B, the lower end of the upper outer mandrel 107 is threaded onto an adapter 131 which is slidable on the upper end portion of the lower inner mandrel 106 and secured thereto by the shear pins 110. Spaced closely above the upper end of the adapter 131, an annular locking slip 132 is carried within an internal annular recess in the upper end of the lower outer mandrel 106 for coacting with the outer surface of the inner mandrel 103 to lock the outer mandrel of the hanger liner at an upward position on the inner mandrel when the locking slips are lifted into expanded locking positions on the slip expanders. The adapter 131 is threaded into a locking slip body 133, having an internal annular recess containing a locking slip 134 for holding the seal assembly 102 expanded when the upper outer mandrel 107 is driven downwardly for expanding the seal assembly. The seal assembly 102 is mounted on the upper end portion of the outer lower mandrel 106 which includes a tubular seal housing 135 at the lower end of the seal assembly. The seal housing 135 has an internal annular recess containing a seal assembly 140 which seals with the outer surface of the inner mandrel 103. The seal housing 135 is threaded on the upper end of a connecting sleeve 141. A coupling 142 is threaded on the mandrel 103 below the connecting sleeve 141. The upper end of the coupling 142 is a stop shoulder limiting the downward movement of the connecting sleeve 141 on the mandrel 103. Still referring to FIG. 4B the coupling sleeve 141, the seal housing 135 carrying the seal 140, the mandrel 106, the seal assembly 102 on the mandrel 106, the adapter 131, and the mandrel 107 are all slidable along the mandrel 103 above the coupling 142. The seal assembly 102, the lock slip adapter 133, the adapter 131, and the mandrel 107 are slidable on the mandrel 106 toward the seal housing 135 after the shear pins 110 have been sheared for purposes of expanding the seal assembly 102 in response to a downward force on the upper end of the mandrel 107 by the dog assembly 305 when the running tool is positioned as illustrated in FIG. 3. Prior to the shearing of the pins 110 the mandrels 106 and 107 are movable as a unit for setting the slips 111 and 112 when the outer mandrel members 106 and 107 are lifted by the running tool coupling 311.

Referring to FIG. 4C, the inner mandrel 103 includes a lower mandrel section **103*b* along which the upper and lower locking dog expanders 104 and 104 are secured by welding. Each of the sets of the upper and lower expanders comprise four tapered members circumferentially spaced at 90° angles around the mandrel section 103*b* longitudinally spaced as shown in FIG. 4C. The upper end of the mandrel 103*b* threads into the lower end of the coupling 142 while the lower end of the mandrel section is externally threaded for connection with the liner 113 which is supported in the well bore by the liner hanger. Referring to both FIGS. 4B and 4C, the upper and lower sets of locking slips 111 and 112 are supported from the connecting sleeve 141 which threads into the seal housing 135. The locking slip sets are supported from four reins or setting arms 143 which are secured along upper end portions by screws 144 to the connecting sleeve 141. As shown in FIG. 4B the connecting sleeve 141 has an external annular flanged portion 145 which is longitudinally slotted at four circumferentially spaced locations as at 150 each of which slots receives one of the setting arms 143 properly positioning and aiding in holding the arms in alignment around the coupling sleeve. As shown in FIGS. 4C and 4D, upper and lower mounting rings 151 and 152 are connected with and supported from the setting arms for supporting the upper and lower slips 111 and 112. The mounting rings fit in sliding relationship around the mandrel section 103*b*. Each of the mounting rings is longitudinally slotted at four locations spaced 90° apart around the external surface of the rings to receive the setting arms so that the four setting arms are connected with both of the rings with the body portion of the rings encircling the mandrel portion 103***b* within the setting arms. The rings 151 and 152 are connected with the setting arms as by screws 153. As shown in FIG. 4C each of the upper locking slips 111 is secured by screws 154 to the upper end portion of a longitudinal strap 155 connected with the ring 151 by screws 160. The mounting straps 155 are fitted along lower end portions in a second set of longitudinal slots formed in the outer surface of the ring 151 between the slots which accommodate the setting arms 143. The mounting straps 155 are formed of a spring-like metal which will permit the upper slips 111 to move outwardly along the expander surfaces of the slip expanders 104. Similarly as shown in FIGS. 4C and 4D, the lower slips 112 are mounted on straps 161 secured by screws 162 to the slips and by screws 163 to the lower mounting ring 152. The lower mounting straps 161 and the lower slips 112 are mounted in exactly the same manner as the upper slips so that the lower slips 112 will move upwardly and outwardly along the expander surfaces of the slip expanders 105 when the outer mandrel of the liner hanger is lifted relative to the inner mandrel. As shown in FIG. 4D stop lugs 164 are welded at 90° intervals around the outer surface of the mandrel section 103*b* below the lower ends of the straps 161 limiting the downward movement of the locking slips harness on the liner hanger mandrel. The harness assembly including the setting arms 143, the mounting rings 151 and 152, and the mounting straps 155 and 161 support the upper and lower slips in a slidable relationship around the liner hanger inner mandrel lower end portion so that when the outer mandrel of the liner hanger is lifted as by the running tool coupling 311, the slips are raised into expanding engagement with the slip expanders 104 and 105.

The handling tool 300 is illustrated in detail in FIGS. 5A–5D inclusive. The tubular mandrel 301 of the handling tool is formed by an upper mandrel section 301*a*, FIGS. 5A and 5B, a central mandrel section 301*b*, FIG. 5C, and a lower mandrel section 301*c*, FIGS. 5C and 5D. Referring to FIG. 5A, a top subassembly 314 is connected on the upper end of the upper mandrel section 301*a* for coupling the running tool with the lower end of the handling string 313. The top subassembly includes a top sub 315 which is threaded on the upper end of the mandrel section 301*a* and held in place by a locking cap 320 threaded on the lower end of the sub 315 around the mandrel and held against loosening by a plurality of set screws 321. A split ring 322 is disposed within recesses provided in the mandrel section 301*a*, the locking cap, and the lower end of the top sub to aid in preventing loosening of the top sub on the mandrel. A ring seal 323 seals between the upper end of the mandrel 301*a* and the top sub to prevent fluid leakage around the connection.

As shown in FIGS. 5B and 5C, the running tool hydraulic piston assembly 310 and the coupling sleeve assembly 311 for connecting the running tool with the outer upper mandrel 107 of the liner hanger are both mounted on the running tool mandrel section 301*a*. The coupling sleeve assembly 311 includes an adjusting nut 324, a shear ring 325 mounted on the adjusting nut below the flanged upper end of the adjusting nut, a stop nut 330 holding the shear nut on the adjusting nut, an externally threaded adjusting nipple 331 threaded through the adjusting nut, and a collet ring 332 threaded on the lower end of the adjusting nipple. The shear nut 325 has a plurality of circumferentially spaced screw holes 326 to receive the shear screws 312 used in connecting the coupling sleeve assembly with the liner hanger outer mandrel. The stop nut 330 is locked on the adjusting nut 324 by set screws 327. Similarly the collet ring 332 is locked on the lower end of the adjusting nipple 331 by set screws 333. The shear ring 325 has a downwardly facing external annular stop shoulder 334 which engages the upper end of the liner hanger mandrel 107 when the coupling sleeve assembly is connected with the liner hanger as shown in FIG. 1. The collet ring 332 has a plurality of downwardly extending locking collet fingers 335 having collet heads 340 which engage a locking recess 341 along a lower enlarged section of the tool mandrel section 301*a* for locking the coupling sleeve assembly 311 against upward movement on the mandrel section 301*a*. The mandrel section 301*a* has an upwardly facing stop shoulder 342 which is engaged by the collet ring 332 limiting the downward movement of the coupling sleeve assembly 311 on the mandrel section 301*a*. The entire coupling sleeve assembly 311 is slidable upwardly on the tool mandrel section 301*a* above the stop shoulder 342 when the collet heads 340 are released from the locking recess 341 in the mandrel section.

The running tool coupling sleeve assembly 311 is operable by the hydraulic piston assembly 310 which includes an annular piston 343 slidable within a cylinder 344 mounted on the running tool mandrel sections 301*a* and 301*b* by a connector 345. A pair of ring seals 350 carried by the piston seals between the piston and the outer surface of the mandrel section 301*a* and a pair of rings seals 351 within the cylinder seal between the inner wall of the cylinder and the outer surface of the annular piston. The annular piston has an enlarged head portion 352 provided with an internal collet release recess 353. The piston is releasably held at a lower end position as shown in FIG. 5B by shear screws 354 which extend through the wall of the upper end portion of the cylinder into the outer wall of the head of the piston. The collet release recess 353 is sized and positioned to allow the collet heads 340 to spring outwardly into the recess freeing the collet ring 332 to move upwardly with the piston. The upper end 355 of the piston is engageable with a downwardly facing shoulder 360 on the collet ring so that the upper end of the piston may engage the collet ring to lift the ring. A plurality of circumferentially spaced ports 361 are formed in the mandrel section 301*a* for hydraulic fluid flow from the bore of the mandrel section into the cylinder 344. The piston 343 is notched internally along the lower end portion at 362 so that when the piston is at the lower end position of FIG. 5B hydraulic fluid may enter the cylinder through the ports 361 to force the piston upwardly. Ring seals 363 seal between the cylinder 344 and the outer wall of the mandrel section 301*a* below the ports 361 sealing the lower end of the cylinder chamber defined by the cylinder 344 with the mandrel section 301*a* in which the piston 343 moves. A split ring 364 positioned between the mandrel section 301*a* and the cylinder 344 and the coupling 345 lock the cylinder and coupling against movement on the mandrel section. The threaded connection between the coupling 345 and the lower end of the mandrel section 301*a* and the lower end of the cylinder 344 and the coupling are opposite in character, one being left hand threads and the other being right hand threads, so that the connection may be rotated without becoming unscrewed. The lower end of the cylinder 344 is also secured by set screws 365 with the coupling 345. The lower end of the coupling 345 threads on the upper end of the central mandrel section 301*b* while a locking cap 370 around the central mandrel section threads on the lower end of the coupling. A split ring 371 is disposed in recesses provided in the upper end of the mandrel section, the lower end of the coupling 345, and the locking cap 370. The locking cap is further secured to the coupling 345 by set screws 372. A ring seal 373 and a ring seal 374 seal between the coupling 345 and the upper mandrel section 301*a* and the central mandrel section 301*b* respectively.

The setting dog assembly 305 of the running tool as shown in FIG. 5C includes a dog ring 375 threaded on the central mandrel section 301*b* held by set screws 380, a dog mandrel 381, a plurality of circumferentially spaced setting dogs 382, dog springs 383, set screws 384 and lock pins 385. The dog ring 375 has an enlarged lower end bore portion which is threaded for engagement of the dog ring also on the upper end of the dog mandrel 381. The dog ring has a downwardly opening internal annular recess 390 which receives the upper end of the dogs 382. A downwardly extending skirt defined in the dog ring 375 by the formation of the recess 390 has circumferentially spaced internally threaded holes which receive the set screws 384 extending inwardly to hold the upper end of the dogs loosely. Referring to FIG. 8 which shows one of the dogs 382 in elevation, each of the dogs has an upper end portion 382*a* which is reduced in thickness and provided with a hole 391 sized to very loosely receive a set screw 384 holding the upper end of the dog loosely within the recess 390 of the dog ring so that the dog may move freely inwardly and outwardly pivoting generally about a line through the dog and the set screw through the hole. The inside face of each of the dogs is provided with a blind hole 392 each of which receives the outward end portion of a dog spring 383 for biasing the lower end of the dog outwardly. The lower end portion of each of the dogs 382 is reduced in thickness defining a retainer flange 393 which has a notch or recess 394 for a lock pin 385 used in guiding and retaining the lower end of each of the dogs in position as the dog is compressed and expanded on the dog mandrel. The reduction in thickness of the lower end portion of each of the dogs also provides a downwardly facing setting shoulder 395 on each of the dogs which is engageable with the upper end edge of the liner hanger outer mandrel 107. The dog mandrel 381 has a central sleeve-like body portion 381*a* which fits on the mandrel section 301*b* threaded along an upper end portion into the dog nut 375. The mandrel body sleeve 381*a* slides onto the mandrel 301*b* but is not threaded thereto. The lower end portion of the dog mandrel is enlarged at 381*b* and provided with a downwardly extending end flange 381*c* and an upwardly opening internal annular recess 381*d* which receives the retainer flanges 393 on the lower ends of the dog. An upwardly extending lip portion 381*e* formed on the lower end of the dog mandrel is provided with circumferentially spaced holes which receive the lock pins 385 extending into the dog mandrel through the annular recess 381*d* and the recess 394 in the lower ends of the dogs 382 holding the lower ends of the dogs in alignment around the dog mandrel while allowing the lower ends of the dogs to move inwardly and outwardly. The lip 381*e* retains the lower ends of the dogs preventing their disengagement from the dog mandrel. The outer surface of the sleeve portion 381*a* of the dog mandrel has blind holes 381*f* which receive the inward ends of the dog springs 383 to hold the dog springs in position around the mandrel body portion behind the dogs. The lower end flange 381*c* on the dog mandrel fits into an upwardly opening recess 400 formed in an enlarged lower end portion 301*b* of the central mandrel section 301*b*. The setting dogs 382 are thus designed to compress inwardly and expand outwardly around the running tool mandrel and are capable of supporting the weight of the running tool and handling string when the running tool is lowered against the upper outer mandrel section 107 of the liner hanger as shown in FIG. 3 when expanding the liner hanger annular seal assembly 102. The lower end of the central mandrel section 301*b* threads on the upper end of the lower mandrel section 301*c*. A locking cap 401 is threaded on the lower end of the central mandrel section 301*b* held by set screws 402. A split ring 403 is disposed in recesses of the lower mandrel section 301*c*, the lower end of the central mandrel section 301*b* and the locking cap 401. A ball bearing assembly 404 is mounted on the lower mandrel section 301*c* below the locking cap 401. The thrust plate 304 is disposed on the lower mandrel section 301*c* below the ball bearing assembly. The lower mandrel section 301*c* has an enlarged section 301*cc* provided with four flat side surfaces 405 circumferentially spaced around the mandrel section at 90° intervals generally defining a square cross section. An upwardly facing stop shoulder 410 is provided on the lower mandrel section 301*c* at the lower end of the enlarged square section 301*cc* limiting the downward movement of the nut 303. The nut 303 has a generally square bore 303*a* which is slightly larger than the square cross section of the mandrel section 301*cc* so that the nut will slide longitudinally on the mandrel. External threads 303*b* are provided on the nut for engagement with the threads 122 within the inner mandrel 103 of the liner hanger. A spring 411 between the thrust plate 304 and the nut 303 biases the nut toward the stop shoulder 410 on the lower mandrel 301*c*. The nut 303 is designed to move longitudinally on the running tool mandrel to permit the running tool to be rotated for disconnection from the liner hanger without upward movement of the running tool during the unthreading process. As shown in FIG. 5D the lower end of the lower mandrel section 301*c* of the running tool is internally threaded at 412 for the connection of suitable standard tools used to temporarily plug the bore of the running tool when hydraulically operating the running tool to set the liner hanger and thereafter for cementing the liner within a well bore through the running tool. For example, the lower end of the running tool may be fitted with a ball seat such as the ball seat 1040 held by the shear pins 1041 and a float shoe mounted from the tool mandrel below the ball seat as shown in FIGS. 1, 2, and 7J of U.S. Pat. No. 4,096,913, such equipment being standard well cementing devices usable with running tools for hydraulic set liner hangers and in standard well cementing operations. The shearable ball seat permits hydraulic pressure to be built up in the running tool for operating the tool and thereafter is displaceable downwardly to allow cement to flow through the tool while the float shoe retains the sheared ball seat and ball within the tool bore while allowing the cement flow necessary for cementing the liner in the well bore.

The first step in the running and setting of the liner hanger 100 with the running tool 300 is the connection of the running tool with the liner hanger. With the liner hanger in the condition represented in FIGS. 4A–4D, and the running tool as shown in FIGS. 5A–5D, the running tool is connected with the liner hanger by engaging the threads 303*b* on the nut 303 of the running tool in the threads 122 at the upper end of the inner mandrel 103 of the liner hanger. The thrust plate 304 rests on the upper end surface 121 of the inner mandrel of the liner hanger. The coupling sleeve assembly 311 telescopes into the upper end of the upper outer mandrel 107 of the liner hanger with the lower end shoulder surface 330*a* of the stop nut 330 resting on the shoulder surface 115 within the liner hanger mandrel 107 and the stop shoulder 334 on the shear ring 325 engaging the upper end of the liner hanger mandrel 107. The shear pins 312 are inserted through the shear pin holes 114 of the mandrel 107 into the holes 326 in the shear nut. Thus the hydraulically operable coupling sleeve assembly 311 is shear pinned to the upper outer liner hanger mandrel 107 while the mandrel section 301*c* of the running tool is connected through the nut 303 into the inner mandrel 103 of the liner hanger. The lower end of the mandrel of the running tool is fitted with the ball shear seat and cementing devices such as the float shoe as described in connection with U.S. Pat. No. 4,096,913. The running tool and liner hanger are then supported from a handling string 313 connected with the top sub assembly 314 of the handling tool. FIG. 1 schematically illustrates the liner hanger and running tool secured together as they are lowered into the well bore.

When the liner hanger supported from the running tool is at the desired depth in the well bore, a ball is dropped down the handling string through the running tool to the shearable ball seat for closing the bore through the running tool. Hydraulic fluid pressure is then increased through the running string into the running tool. The pressure acts from the bore of the mandrel of the running tool through the ports 361 of the upper mandrel section 301*a* into the cylinder 344 against the lower end of the piston 343. The pins 354 are sheared releasing the piston to move upwardly. As the piston moves upwardly, when the piston release recess 353 is aligned with the collet heads 340 on the lower end of the collet fingers 355 depending from the collet 332, the collet heads are free to move outwardly into the release recess 353. Thus, when the upper end 355 of the piston 343 engages the shoulder 360 on the collet, the collet heads and fingers spring outwardly releasing the coupling sleeve assembly 311 so that the entire assembly with the nipple 331 sliding along the mandrel section 301*a* is forced upwardly by the hydraulic pressure lifting the piston 343. Since the liner hanger upper outer mandrel 107 is shear pinned to the coupling sleeve assembly 311 of the handling tool, the outer mandrel of the liner hanger is lifted upwardly by the hydraulic pressure. The upward movement of the liner hanger outer mandrel raises the outer mandrel relative to the inner mandrel 103 lifting the seal assembly 102, the seal housing 135 and the connecting sleeve 141 upwardly on the inner mandrel. The upward movement of the connecting sleeve raises the setting arms 143 which pull the slip mounting rings 151 and 152 upwardly forcing the upper slips 111 and the lower slips 112 upwardly along the upper slip expanders 104 and the lower slip expanders 105 respectively. As the upper and lower slips move upwardly and outwardly along the upper and lower slip expanders the slips move out into engagement with the inner wall surface of the casing C until they are wedged between the slip expanders and the casing at which time the pins 312 shear thereby releasing the coupling sleeve 311 from the upper end of the outer mandrel 107 of the liner hanger. FIGS. 6A–6D illustrate the position of the various parts of the running tool and the liner hanger after the upper and lower slips have been partially expanded along the slip expanders prior to the shearing of the pins 312. It will be seen in FIG. 6A that the collet finger heads 340 have been cammed outwardly from the locking recess 341 into the release recess 353 of the piston 343 which is forcing the nipple 331 upwardly raising the coupling sleeve assembly 311 for setting the slips. It will also be noted in FIG. 6B that the nut 303 and the thrust plate 304 remain engaged with the inner mandrel 103 of the liner hanger thereby holding the inner mandrel while the outer mandrel is lifted to set the slips. During this slip setting procedure the shear pins 110 which interlock the upper and lower sections of the outer mandrel of the liner hanger remain intact so that the seal assembly 102 is not affected by the slip setting procedure. After the pins 312 shear the upward force at the well head holding the string of tools and liner may be relaxed so that the upper and lower slips support the weight of the liner. The weight of the running tool and the running string 313 may rest on the upper end of the inner liner hanger mandrel 103 through the thrust plate 304. The downward force on the inner mandrel 103 by the string of liner 113 and the running tool and its handling string tends to further tighten the slips because the slip expanders 104 and 105 are urged downwardly within the slips since such expanders are mounted directly on the mandrel 103.

Following the setting of the slips as described, the procedure of cementing the liner 113 in the well bore by pumping cement slurry downwardly through the handling string and running tool and outwardly into the well bore upwardly around the liner hanger may be carried out. This is a standard well know procedure described and illustrated in some detail in U.S. Pat. No. 4,096,913. Initially, the pressure within the running tool is increased until the hydraulic force on the ball seat assembly 1040 forces the shear pins holding the seat to shear releasing the seat to drop downwardly so that cement slurry may be pumped through the running tool as shown in some detail in FIGS. 2 and 3 of U.S. Pat. No. 4,096,913. With the ball seat assembly at the lower end position the cement slurry may be pumped through the float shoe at the lower end of the running tool outwardly into the well bore and upwardly around the liner and the liner hanger to a level above the seal assembly 102 which is not yet set and is thus still retracted from the casing wall. The cement slurry is pumped downwardly through the handling string and the running tool followed by a plug assembly such as the assembly 1000 as illustrated in FIGS. 4–6 of U.S. Pat. No. 4,096,913. After the cement is pumped above the seal assembly 102 the running tool 300 is disengaged from the liner hanger 100 by rotating the handling string 313 and the running tool causing the nut 303 to unthread from the liner hanger inner mandrel threads 122. The nut being loosely fitted on the square length of the mandrel of the running tool allows the nut to be rotated while the nut travels upwardly against the spring 411 permitting disengagement of the nut from the liner hanger inner mandrel without lifting the running tool and its handling string. When the nut is disengaged the handling string and running tool are lifted above the liner hanger and lowered back to the liner hanger until the setting dog assembly 305 engages the upper end edge of the liner hanger upper outer mandrel 107. This stage is represented in both FIGS. 3 and 7A. As the running tool is lifted upwardly from the liner hanger when the dogs 382 pass above the upper end of the linear hanger outer mandrel, the springs 383 expand the dogs so that the running tool is lowered back into the liner hanger the shoulders 395 on the dogs engage the upper end edge of the mandrel 107 of the liner hanger. The weight of the running tool and its handling string is allowed to rest on the upper end of the mandrel 107 applying a downward force to the mandrel which is transmitted through the mandrel parts to the shear pins 110 holding the adapter 131 against downward movement. The shear pins 110 engage the upper end portion of the lower outer mandrel 106 which is held against downward movement because the upper and lower slips 111 and 112 are wedged against the casing wall preventing the mandrel 106 down through and including the connecting sleeve 141 from moving downwardly. As soon as the pins 110 shear the upper outer mandrel 107, the adapter 131, and the lock slip body 133 slide downwardly compressing and expanding the seal assembly 102 into engagment with the inner wall of the casing C. When the seal assembly is compressed sufficiently to stop downward movement of the mandrel 107 the lock slip 134 locks the mandrel and related parts downwardly relative to the mandrel 106 holding the seal assembly expanded. The relative positions of the relevant parts of the running tool and the liner hanger including the upper slips 111 of the liner hanger are shown in detail in the drawing FIGS. 7A–7C inclusive. With the liner hanger now fully set and the seal assembly expanded, the running tool is lifted to the surface by the handling string 313.

It will now be understood that a new and improved liner hanger and running tool have been described and illustrated. The liner hanger and running tool are hydraulically operable minimizing the manipulation of the handling string. The liner hanger is of the delayed action type wherein the slips are first fully set and thereafter in a completely separate operation the seal is expanded. The expandible seal assembly on the liner hanger is mounted on an outer sleeve-like mandrel of the liner hanger so that slip manipulation for setting the slips may occur through the seal assembly.

What is claimed is:

1. Apparatus for anchoring a string of well bore liner in a well comprising: a tubular body mandrel; an expandible seal on said body mandrel for sealing between said mandrel and the wall of said well; normally retracted expandible gripping means on said mandrel for locking said mandrel with the wall of said well; separate hydraulic means removably connected with said body mandrel for expanding said gripping means; and mechanical force applying means connected with said hydraulic means for mechanically releasably engaging said body mandrel to mechanically expand said seal after hydraulically expanding said gripping means; said hydraulic and mechanical force applying means being disengageable and removable from said body mandrel after expanding said gripping means and said seal.

2. Apparatus in accordance with claim 1 wherein said body mandrel comprises telescoping inner and outer mandrels; said seal is mounted on said outer mandrel; said gripping means is connected between said inner and said outer mandrels; said hydraulic means is connectible between said inner and outer mandrels; and said mechanical means is engageable with said outer mandrel.

3. Apparatus for anchoring a string of liner in a well bore and sealing with the wall of said well bore comprising: an outer upper tubular body mandrel; an outer lower tubular body mandrel telescopically connected with said upper body mandrel; a seal assembly on one of said outer body mandrels expandible by relative longitudinal movement between said outer body mandrels; an inner tubular body mandrel slidably telescoped into said outer body mandrels; normally retracted gripping means around said inner body mandrel below said outer body mandrels and connected with said lower outer body mandrel expandible by relative motion between said inner and outer body mandrels; first mechanical means for releasably coupling with said inner body mandrel; hydraulic means connected with said first mechanical means and releasably connectible with said outer body mandrel to move said outer body mandrel relative to said inner body mandrel for expanding said gripping means; and second mechanical means connected with said first mechanical means and said hydraulic means for releasably engaging one of said outer body mandrels for moving said mandrel relative to the other of said outer body mandrels for expanding said seal assembly after expanding said gripping means.

4. Apparatus in accordance with claim 3 including locking means between the inner mandrel and one of the outer mandrels for holding said gripping means expanded and locking means between said outer mandrels for holding said seal assembly expanded.

5. Apparatus in accordance with claim 4 wherein said gripping means includes slip expanders on said inner body mandrel and slips supported from said outer lower body mandrel adapted to coact with said slip expanders for expanding said slips responsive to relative movement between said inner and outer body mandrels.

6. Apparatus in accordance with claim 5 wherein said first mechanical means is a threaded nut adapted to engage said inner mandrel.

7. Apparatus in accordance with claim 6 wherein said second mechanical means comprises an expandible setting dog assembly having radially movable dogs adapted to engage an upper end edge of said upper body mandrel.

8. Apparatus in accordance with claim 7 wherein said hydraulic means comprises an annular cylinder, an annular piston movable in said cylinder, a sleeve member having a locking collet thereon engageable by said annular piston, and means for connecting said sleeve member with said upper outer body mandrel.

9. Apparatus in accordance with claim 8 including a thrust plate connected with said first and second mechanical means for engaging the upper end of said inner mandrel.

10. Apparatus for running and anchoring a well bore liner within a well bore comprising: a liner hanger including a tubular upper outer body mandrel, a tubular lower outer body mandrel, shear pin means connecting an upper portion of said lower body mandrel with a lower portion of said upper body mandrel, an external annular expandible seal assembly supported on said lower body mandrel adapted for expansion responsive to downward movement of said upper body mandrel on said lower body mandrel, a lock slip between said upper body mandrel and said lower body mandrel for holding said mandrels against relative movement after expansion of said seal assembly, a tubular inner body mandrel telescoped into said outer body mandrels extending at one end beyond the lower end of said lower outer body mandrel, an external annular collar on said inner body mandrel limiting the movement of said inner body mandrel into said outer body mandrels, upper and lower slip expanders on said inner body mandrel below said collar, slip support arms secured along upper ends to the lower end of said lower outer body mandrel, slips support rings secured with said slip support arms around said inner body mandrel, and slips secured with said support rings for movement along said slip expanders for expanding said slips to lock said liner hanger with a well bore wall responsive to upward movement of said outer mandrels on said inner mandrel, a lock slip between said inner mandrel and said lower outer mandrel for locking said inner mandrel and said lower outer mandrel against relative movement after setting said slips on said slip expanders, means along the lower end of said inner mandrel for connecting a string of well bore liner, and means including internal threads along the upper end portion of said inner mandrel for coupling a running tool with said liner hanger; and a running tool for said liner hanger including a tubular body mandrel having means at the upper end thereof for connection with a tubular handling string, a coupling sleeve assembly on said running tool mandrel including a shear pin nut securable by shear pins in the upper end of said upper outer mandrel of said liner hanger, said coupling sleeve being mounted in slidable relation on said running tool mandrel, releasable locking means connected with said coupling sleeve and releasable lockable with said running tool mandrel, a hydraulic piston assembly having an annular piston around said running tool mandrel engageable at one end with said coupling sleeve, an annular cylinder around said annular piston, port means in said running tool mandrel from the bore thereof into said annular cylinder for hydraulic fluid to force such cylinder against said coupling sleeve, means on said annular cylinder coacting with said locking means on said coupling sleeve for releasing said locking means responsive to movement of said annular cylinder, a setting dog assembly including a plurality of radially movable setting dogs on said running tool mandrel spaced from said hydraulic cylinder said setting dogs having shoulder surfaces engageable with the upper end surface of said upper outer liner hanger mandrel for forcing said mandrel downwardly to expand said seal assembly on said liner hanger, a coupling nut on said running tool mandrel engageable with said internally threaded upper end portion of said liner hanger inner mandrel, an annular thrust plate on said running tool mandrel between said nut and said setting dog assembly for engagement with the upper end of said liner hanger inner mandrel when said nut is engaged with said inner mandrel, and means on the lower end of said running tool mandrel for connection of flow control and well cementing tools.

11. Apparatus in accordance with claim 10 wherein said nut on said running tool mandrel is provided with a square bore and said running tool mandrel is square in cross section along a portion of which said nut is mounted, said nut fitting in sliding relationship on said running tool mandrel permitting said nut to move longitudinally on said mandrel while being rotated by said mandrel, a spring around said running tool mandrel between said annular thrust plate and said nut baising said nut away from said thrust plate, and a bearing assembly around said running tool mandrel adjacent said thrust plate between said thrust plate and said setting dog assembly to permit rotation of said running tool for disengaging said nut from said inner mandrel of said liner hanger while the weight of said running tool and a handling string connected with said running tool is supported by said thrust plate on said liner hanger inner mandrel.

12. Apparatus in accordance with claim 11 wherein said locking means on said coupling sleeve comprises an annular collet having collet fingers provided with enlarged collet heads, an external annular locking recess provided around said running tool mandrel for said collet heads to lock said collet against movement on said running tool mandrel,and an internal annular collet release recess within the head end of said annular piston for alignment with said collet heads responsive to movement of said annular piston toward said coupling sleeve to permit said collet to release for movement of said coupling sleeve responsive to hydraulic pressure movement of said annular piston.

13. A liner hanger for supporting a string of well liner in a well bore comprising: a body mandrel including a tubular upper outer body mandrel, a tubular lower outer body mandrel, shear pin means connecting an upper portion of said lower body mandrel with a lower portion of said upper body mandrel, an external annular expandible seal assembly supported on said lower body mandrel adapted for expansion responsive to downward movement of said upper body mandrel on said lower body mandrel, a lock slip between said upper body mandrel and said lower body mandrel for holding said mandrels against relative movement after expansion of said seal assembly, a tubular inner body mandrel telescoped into said outer body mandrels extending at one end beyond the lower end of said lower outer body mandrel, an external annular collar on said inner body mandrel limiting the movement of said inner body mandrel into said outer body mandrels, upper and lower slip expanders on said inner body mandrel below said collar, slip support arms secured along upper ends to the lower end of said lower outer body mandrel, slips support rings secured with said slip support arms around said inner body mandrel, and slips secured with said support rings for movement along said slip expanders for expanding said slips to lock said liner hanger with a well bore wall responsive to upward movement of said outer mandrels on said inner mandrel, a lock slip between said inner mandrel and said lower outer mandrel for locking said inner mandrel and said lower outer mandrel against relative movement after setting said slips on said slip expanders, means along the lower end of said inner mandrel for connecting a string of well bore liner, and means incuding internal threads along the upper end portion of said inner mandrel for coupling a running tool with said liner hanger.

14. A running tool for running, setting and anchoring a well bore liner hanger comprising: a tubular body mandrel having means at the upper end thereof for connection with a tubular handling string, a coupling sleeve assembly on said running tool mandrel including a shear pin nut securable by shear pins in the upper end of an upper outer mandrel of said liner hanger, said coupling sleeve being mounted in slidable relation on said running tool mandrel, releasable locking means connected with said coupling sleeve and releasable lockable with said running tool mandrel, a hydraulic piston assembly having an annular piston around said running tool mandrel engageable at one end with said coupling sleeve, an annular cylinder around said annular piston, port means in said running tool mandrel from the bore thereof into said annular cylinder for hydraulic fluid to force such cylinder against said coupling sleeve, means on said annular cylinder coacting with said locking means on said coupling sleeve for releasing said locking means responsive to movement of said annular cylinder, a setting dog assembly including a plurality of radially movable setting dogs on said running tool mandrel spaced from said hydraulic cylinder, said setting dogs having shoulder surfaces engageable with the upper end surface of an upper outer liner hanger mandrel for forcing said mandrel downwardly to expand said seal assembly on said liner hanger, a coupling nut on said running tool mandrel engageable with an internally threaded upper end portion of said liner hanger inner mandrel, an annular thrust plate on said running tool mandrel between said nut and said setting dog assembly for engagement with an upper end of said liner hanger inner mandrel when said nut is engaged with said inner mandrel, and means on the lower end of said running tool mandrel for connection of flow control and well cementing tools.

15. A liner hanger for supporting a string of liner in a well bore and sealing with the well bore wall comprising: a first outer tubular body mandrel; a second outer tubular body mandrel telescopically connected with said first outer mandrel; an external annular expandible seal assembly supported on one of said outer body mandrels and expandible responsive to telescopic movement of one of said outer body mandrels toward the other of said outer body mandrels; releasable means holding said outer body mandrels together for movement as a unit responsive to a longitudinal force applied to one of said mandrels below a predetermined value and releasable responsive to a longitudinal force applied to one of said outer mandrels above a predetermind value for expanding said seal assembly; lock slip means between said outer body mandrels for locking said mandrels against relative movement after said seal assembly is expanded; a third tubular inner body mandrel telescoped into said outer body mandrels and extending along one end portion from one of said outer body mandrels; an expandible slip assembly for anchoring said liner with a well bore wall connected around said body mandrels coupled between said inner body mandrel and one of said outer body mandrels for expansion responsive to movement of said outer body mandrels as a unit relative to said inner body mandrel; and lock slip means between said inner body mandrel and one of said outer body mandrels for locking said slip means expanded against said well bore wall.

16. A liner hanger in accordance with claim 15 wherein said slip means comprises slip expanders on said inner body mandrel, a locking slip mounting harness connected with one of said outer body mandrels supported around said inner body mandrel, and locking slips mounted on said harness for engagement with said slip expanders upon relative movement of said outer body mandrels relative to said inner body mandrel.

17. A handling tool for running and setting a liner hanger in a well bore comprising: a tubular body mandrel; a coupling member along one end of said body mandrel for releasably connecting said tool with an inner body mandrel of said liner hanger; a thrust plate on said handling tool body mandrel spaced from said coupling member for engaging an end of said inner body mandrel of said liner hanger; a setting dog assembly on said handling tool body mandrel adapted to radially expand and contract for engagement with an end of one of said liner hanger outer body mandrels for expanding a seal assembly on said liner hanger outer body mandrels; a coupling sleeve assembly on said handling tool body mandrel including means for releasably connecting said coupling assembly with one of said liner hanger outer body mandrels for moving said body mandrels to expand slip means on said liner hanger; and a hydraulic piston assembly on said handling tool body mandrel operable with said coupling sleeve assembly to hydraulically actuate said coupling sleeve assembly for setting said slip means of said liner hanger.

18. A liner hanger for supporting a string of liner in a well bore and sealing around said liner with the wall of said well bore, said liner hanger comprising: a first outer body mandrel having telescoping parts; a second inner body mandrel in said outer mandrel; well bore wall gripping means coupled between said inner and outer mandrels for expansion into said well bore wall responsive to relative movement between said inner and outer mandrel; and an annular seal on said outer mandrel for sealing around said outer mandrel with said well bore wall responsive to relative movement between said telescoping parts of said outer mandrel.

* * * * *